United States Patent [19]

Brooks

[11] 4,256,307

[45] Mar. 17, 1981

[54] MAGNETIC GAME

[76] Inventor: Lesley P. Brooks, 400 W. Taylor, McAlester, Okla. 74501

[21] Appl. No.: 98,604

[22] Filed: Nov. 29, 1979

[51] Int. Cl.[3] ..... A63F 7/00

[52] U.S. Cl. ..... 273/118 A; 273/1 M; 335/304

[58] Field of Search ..... 273/118 A, 119 A, 120 A, 273/121 A, 122 A, 123 A, 124 A, 125 A, 1 M; 46/236; 335/304

[56] References Cited

U.S. PATENT DOCUMENTS

| | | | |
|---|---|---|---|
| 2,665,912 | 1/1954 | Juran | 273/118 A |
| 2,707,106 | 4/1955 | Cunningham | 273/118 A X |
| 3,085,802 | 4/1963 | Yarashes | 273/118 A |
| 3,090,622 | 5/1963 | Sire | 273/118 A X |

*Primary Examiner*—Anton O. Oechsle
*Attorney, Agent, or Firm*—William S. Dorman

[57] ABSTRACT

A magnetic game comprising a gameboard for use with a magnetizable metal game ball. The gameboard comprises a non-metallic, non-magnetizable rectangular block having a central recess, a thin, non-magnetizable rectangular top plate and a plurality of target areas on a portion of the top plate over the central recess. A thin magnetizable metallic sheet, substantially the same size and shape as the recess, is disposed at the bottom of the recess. A magnetic plate is disposed in the recess over the metallic sheet. A plurality of smaller individual magnetic target elements is disposed on the magnetic plate wherein each element is disposed beneath a target area on the gameboard whereby the game ball is rolled on the top plate and comes to rest over one of the magnetic elements.

6 Claims, 4 Drawing Figures

MAGNETIC GAME

BACKGROUND OF THE INVENTION

1. Field of the Invention

The present invention relates to a magnetic game for the playing of a conventional game, more particularly a form of tic-tac-toe. The basic invention is self-contained but can be altered into different games which incorporate electronics.

2. Description of the Prior Art

Magnetic games are well known in the prior art. However, none of the prior art devices incorporates a relatively large magnetic plate with relatively smaller and spaced magnetic target elements superimposed on the larger magnetic plate to create a magnetic circuit. Furthermore, the prior art fails to show a magnetic amplification means in the form of a magnetizable sheet disposed below the magnetic plate. The prior art devices also generally require manual means, such as shaking a game board or using a cue stick to propel various game markers about their respective playing surfaces.

SUMMARY OF THE INVENTION

An object of the present invention is to provide a self-contained magnetic means for propelling a game marker in the form of a metal ball about a smooth playing surface. The magnetic means are provided by a permanent magnetic circuit requiring no electricity for the fluid movement of the game ball. The strong magnetic force of the circuit contains the game ball within a game field thereby eliminating the use of side rails and the like.

The magnetic game of the present invention comprises a steel game ball and a gameboard. The gameboard is comprised of a top and a bottom rectangular plastic plate. The top plate rests on a rectangular wood supporting block affixed along the perimeter of the bottom plate. The two plates are interconnected by brads mounted on the top plate and received into holes in the wood block.

The magnetic circuit is housed in a central recess of the wood block between the two plates. The magnetic circuit is comprised of a permanent ceramic magnetic plate and four smaller permanent magnetic elements mounted on the magnetic plate. Each magnetic element has a hole in its center creating a neutral area or blotch zone. The blotch zone provides a means for aligning the game ball on the game targets of the playing surface. A ferrous-type (magnetizable) metal sheet beneath the magnetic circuit amplifies the strength of the magnetic force. The metal sheet is also employed as a keeper.

A stand affixed to the underneath side of the bottom plate comprises a pivotal ball joint post affixed to a base. The stand provides an adjustment means for the level positioning of the gameboard.

The playing surface of the gameboard is provided with a visible bubble level mounted flush in its center. The bubble level provides a means for assuring a constant level position of the gameboard.

An imaginary horizontal line extending traversely across the center of the playing surface divides the latter into a positive half and a negative half. A central rectangular box contains a game field which is comprised of a series of radiating ellipses of successively larger sizes.

The central and smallest ellipse contains the visible bubble level. The next larger ellipse outward from the center contains for multi-colored circles. One of the circles is off a solid color and the remaining circles are individually colored, each having a ring about it the same color as the solid circle. The circles or game targets are in direct alignment over the magnetic elements.

The remaining two ellipses each contain eighteen launch elements, launch arrows and cross-haired circles or launch pads. The entire series of ellipses is divided by degree lines running through the center and extending to the ends of the playing surface. The launch arrows and the vertical cross-hairs of the circles are in alignment with the degree lines.

Thirty-six boxes are provided along the perimeter of the central rectangular box. These boxes may be calibrated in degrees from 0 to 360 in increments of 10 degrees.

A positive scoring zone and a negative scoring zone are located at the ends of their respective sides. Each scoring zone contains an identification box, a starting box and three square scoring boxes.

The game ball is set into play when it is positioned on a selected launch pad and is subsequently released. The ball is drawn into the game field by the strong magnetic force emitted from the magnetic circuit. The ball exhibits a fluid movement about the game field until it comes to rest over a game target.

Although the present invention is primarily designed for use with permanent magnets, one modification involves the substitution of electrical core-heads for one or more of the individual magnetic target elements. The flow of electricity to the coil surrounding the core-head can be controlled, for example, by a coin-activated timing device or by a switch which can be activated by an individual player. The electrical current can be employed not only to magnetize the core-heads but also in certain cases to change the magnetic polarity of a target element.

DETAILED DESCRIPTION OF THE PREFERRED EMBODIMENTS

The magnetic game provides a self-contained magnetic means for propelling a magnetizable metal game ball about a gameboard. The present invention provides for the play of a conventional game, more particularly a form of tic-tac-toe.

Figure 1:
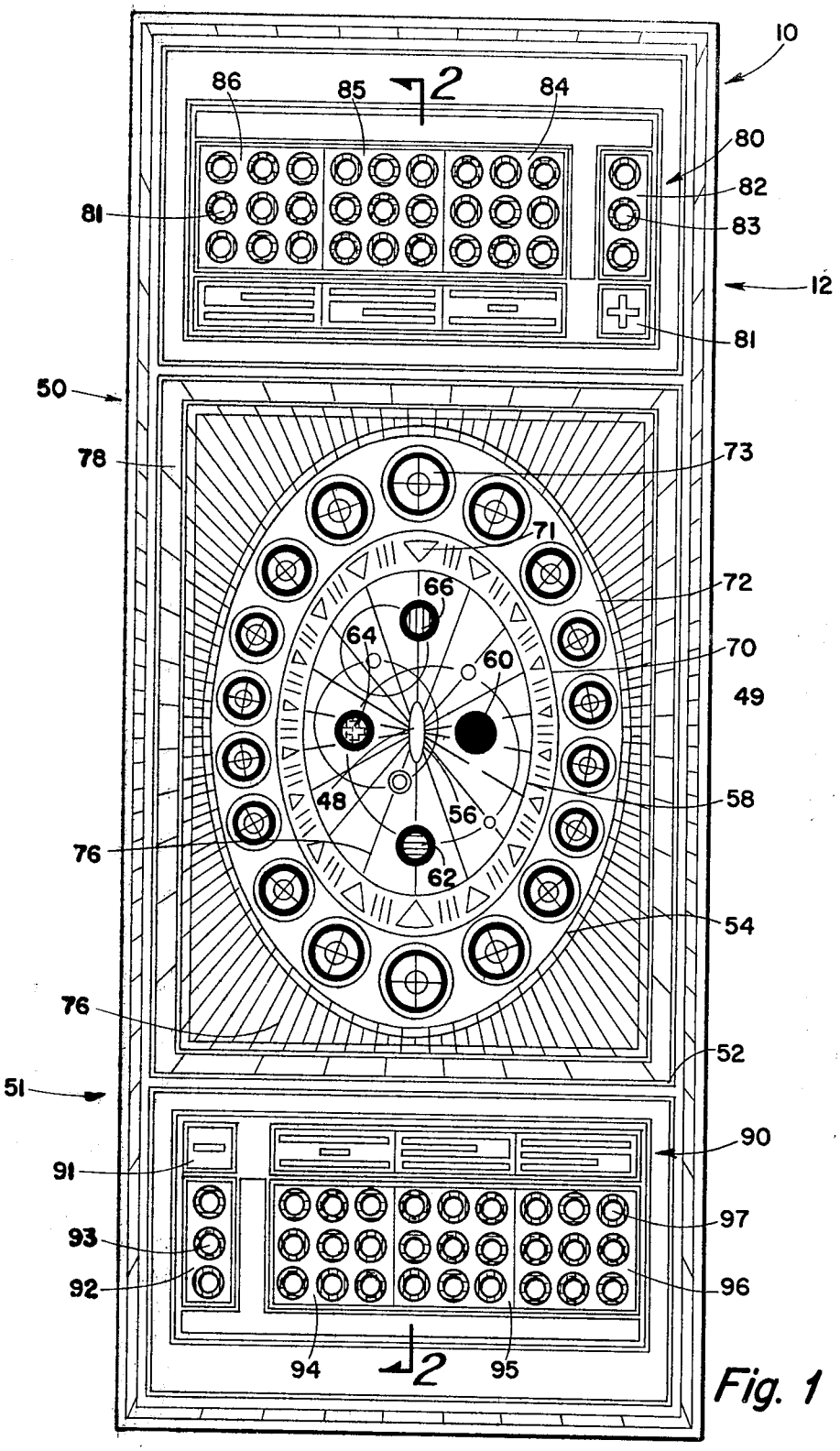
FIG. 1 is a top plan view of the gameboard showing the playing surface of the present invention.

Referring to FIG. 1, a playing surface 10 mounted on top of a gameboard 12 is illustrated, the details of which will be described hereafter.

Figure 2:
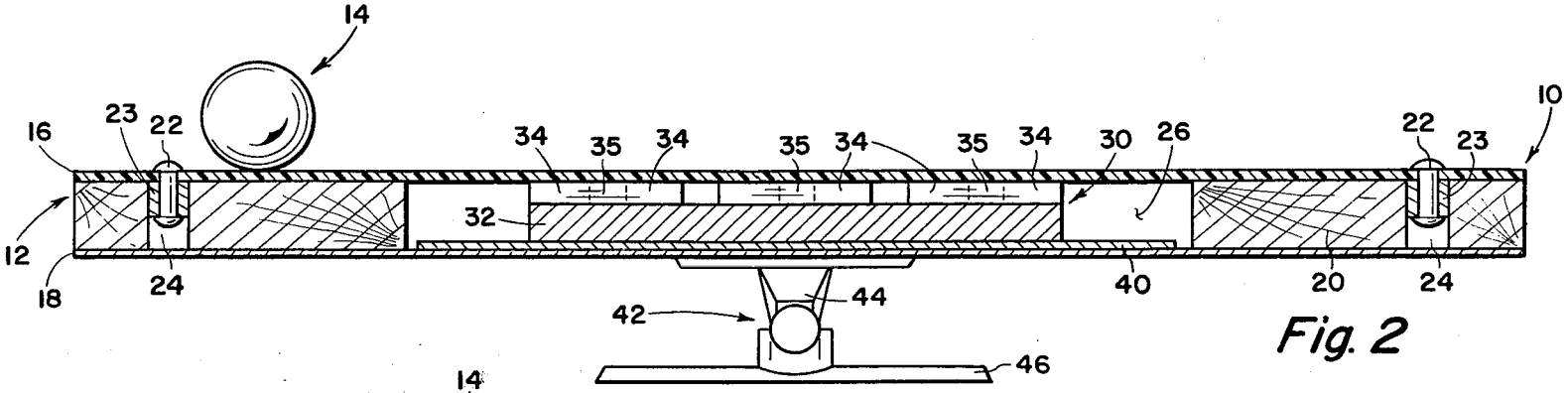
FIG. 2 is a cross-section of the gameboard taken along line 2—2 of FIG. 1.

In FIG. 2, a steel ball 14 is shown positioned on playing surface 10. Gameboard 12 is comprised of a top rectangular cover plate 16 and a bottom rectangular plate 18. Plates 16 and 18 are of substantially equal size and are constructed from a non-metallic material, preferably plastic. A non-metallic, preferably wood, supporting block 20 is sandwiched between plates 16 and 18 and is affixed to bottom plate 18 by conventional means such as glue. Plate 16 is mounted on block 20 by means of a set off brads 22, two of which are shown. Brads 22 are received into sleeves 23 mounted within suitable holes 24 in supporting block 20. Top plate 16, bottom plate 18 and supporting block 20, in this example, have dimensions of 6"×15"; however, block 20 is substantially thicker than plates 16 and 18.

A magnetic circuit 30 is housed within a central recess 26 of supporting block 20. Magnetic circuit 30 is comprised of a one-piece magnetic plate 32 and four identical smaller spaced magnetic elements 34, only three of which are shown. Magnetic plate 32 and magnetic elements 34 are rectangular, although they may be of any shape desired. Plate 32 and elements 34 are permanent ceramic magnets which can be obtained from manufacturers such as Stockpole or Magno-Ceram. In this example, the dimensions of plate 32 are 2"×3"×¼", and the dimensions of elements 34 are 1"×¾"×3/16".

Magnetic elements 34 are mounted on magnetic plate 32 in an alignment which will be described hereafter. Each element 34 has a central hole 34 which provides a neutral area or "blotch" zone. The blotch zones are employed to align steel ball 14 over the center of elements 34.

A ferrous-type or magnetizable metal sheet 40 is disposed beneath magnetic plate 32. Metal sheet 40 rests on top of bottom plate 18 and is fitted within recess 26, wherein recess 26 and metal sheet 40 are substantially equal in size. The dimensions of recess 26 and sheet 40 are 1½"×4", although all of the above given dimensions may vary proportionately. Metal sheet 40 provides an amplification means for the magnetic force of circuit 30 and also constitutes a keeper.

Magnetic circuit 30 provides a self-contained means for propelling ball 14 to the center of playing surface 10 and the smaller magnetic elements 34 are employed to stop ball 14. The strong magnetic force emitted from circuit 30, which is augmented or amplified by metal sheet 40, contains ball 14 on gameboard 12.

A mechanical means for leveling gameboard 12 is provided by stand 42 affixed to the underneath side of plate 18. In the present invention, stand 42 is comprised of a pivotal ball joint post 44 affixed to a base 46.

As shown in FIG. 1, playing surface 10 is mounted on top plate 16. Gameboard 12 is provided with a visible bubble level 48 mounted flush with playing surface 10 in its center. Bubble level 48 is used in conjunction with stand 42 by maintaining the bubble in the center of level 48, thus assuring a constant level position of gameboard 12.

An imaginary horizontal line extending traversely across the center of playing surface 10, herein shown as a dotted line 49, divides playing surface 10 into a positive half 50 and a negative half 51.

A central rectangular box 52 contains a game field 54. Game field 54 is comprised of a series of radiating and successively larger ellipses, the central and smallest ellipse 56 containing visible bubble level 48. The next larger ellipse 58, moving from the center outwards, contains four multi-colored circles or game targets 60, 62, 64 and 66. Game target 60 is a solid colored circle; the remaining targets 62, 64 and 66 are different individual colors, each circle having a ring which is colored the same as target 60. Each game target, such as 62, has a corresponding magnetic element 34 aligned directly beneath the target with its respective hole 35 in alignment with the center of the target. It should be noted that although four circles are represented as the game targets, any other plurality of game targets can be employed provided that each game target is aligned over its respective magnetic element.

The remaining two ellipses, a marker ellipse 70 and a launch ellipse 72, each contain eighteen elements which are used in conjunction with each other. Each launch arrow 71 is in alignment with a respective cross-haired circle 73, hereinafter designated as a launch pad.

The series of ellipses in game field 54 is divided by degree lines 76 which run from the center of playing surface 10 and extend to its ends. The points of launch arrows 71 and the vertical cross-hairs of launch pads 73 are in alignment with degree lines 76, showing the relationship of arrows 71 and pads 73 to the center of playing surface 10.

A set of thirty-six boxes 78 is contained along the perimeter of rectangular box 52. Boxes 78 may be calibrated in degrees from 0 to 360 in increments of 10 degrees. The calibration of boxes 78 provides a visible means of determining the exact degree of a selected launch pad 73.

At the ends of positive half 50 and negative half 51 are a positive scoring zone 80 and a negative scoring zone 90, respectively. Scoring zone 90 comprises an identification box 91 showing a player has chosen to play negative half 51. A starting box 92 contains colored plastic pegs (not shown) recessed into holes 93, all of which correspond to the colors of game targets 60, 62, 64 and 66. To the right of starting box 92 are are three square scoring boxes 94, 95 and 96. Each scoring box contains nine colored scoring holes 97. Holes 97 are ringed in colors which correspond to game targets 62, 64 and 66, with the center of each hold 97 having the same color as game target 60.

The components 82 through 87 of positive scoring zone 80 are identical to the aforementioned components 92 through 97 of negative scoring zone 90. The identification box 81 is provided to identify the player's choice of positive half 50.

When steel ball 14 is positioned on a selected launch pad 73 and is subsequently released, the magnetic energy emitted from magnetic circuit 30 instantly seizes and pulls ball 14 into the central area of game field 54. Ball 14 exhibits a fluid movement about game field 54 until ball 14 reaches a state of stability, randomly stopping on one game target 60, 62, 64 or 66. Although in theory, one might suppose that ball 14 should stop on the same target each time it is released from the same launch pad 73, this is not necessarily true.

The player scores a game target by moving a peg from starting box 92 into a hole 97 of the same color as the game target. When ball 14 comes to rest on game target 60, target 60 is scored as a free turn. The play continues as described above wherein the object is similar to a conventional tic-tac-toe game. Many variations of the aforementioned game can be designed including incorporating lights for the pegs in scoring zones 80 and 90.

Figure 3:
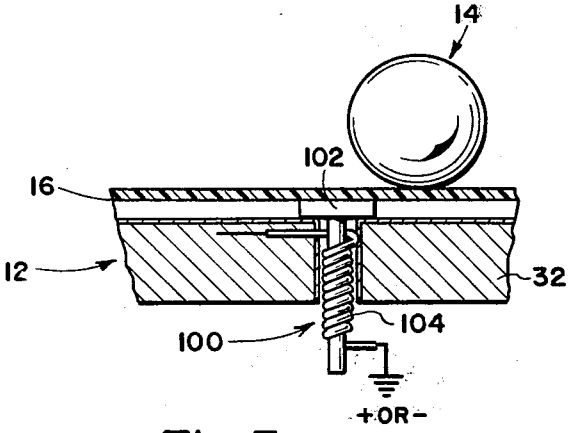
FIG. 3 is a cross-sectional view of a modification of the present invention showing a magnetizable target element that can be electrically activated.

FIG. 3 illustrates a variation of the present invention. An electrical core-head 100 has been substituted for a magnetic element 34, magnetic plate 32 remaining as a permanent ceramic magnet. Corehead 100 is comprised of a magnetizable core 102 and a surrounding electric coil 104 wherein an electrical current flows and subsequently magnetizes core 102. The electrical current can be controlled by a timing device, which can be coin-activated, or by switches.

In the coin-operated version, the game plays as above until the timing device (not shown) stops the flow of the electrical current to coreheads 100. Ball 14 is then attracted to the outer edges of magnetic plate 32 and will remain in place until another coin activates the timing device.

Figure 4:
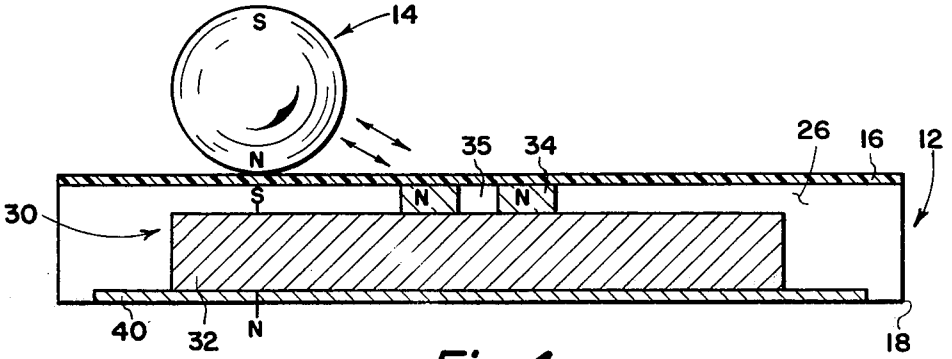
FIG. 4 is a simplified representation of a magnetic effect which can be produced by the apparatus of FIG. 3 where the polarity of a magnetic target element is reversed.

FIG. 4 diagramatically demonstrates how it would be possible to vary the reaction of ball 14 by reversing the polarity of a magnetic element 34. One way that this reversal of polarity could be accomplished is with the circuit of FIG. 3, wherein the direction of current through coil 104 would be reversed. A switch (not shown) which could be activated by the individual players, could be employed to control the current flow to one or more magnetic elements. Returning to a consideration of FIG. 4, steel ball 14 is in a state of magnetic induction throughout the game play induced into it by magnetic circuit 30, annd subsequently behaves as a magnetic complete with north and south poles. When a player employs a switch (not shown, as indicated above) to reverse the polarity of element 34, a given ball 14 can be repelled away from element 34 as shown. This modification introduces a new means of controlling game ball 14 and provides for additional variations on the game.

What is claimed is:

1. A magnetic game comprising a gameboard for use with a magnetizable metal game ball, said gameboard comprising a non-magnetizable block of a pre-determined size and shape having a central recess, said central recess having a bottom and being of a predetermined size and shape, a thin non-magnetizable top plate of substantially the same size and shape of said block disposed over said block and said central recess therein, means defining a plurality of target areas on a portion of the said top plate over said recess, a thin magnetizable metallic sheet of substantially the same size and shape of said recess disposed at said bottom of said recess, a magnetic plate of similar shape and smaller size relative to said sheet disposed in said recess over said metallic sheet, a plurality of individual magnetic target elements of smaller size than said magnetic plate disposed on said magnetic plate with one said magnetic element disposed beneath each said target area whereby said magnetizable game ball can be rolled on said top plate over said central recess to come to rest over one of said magnetic target elements.

2. A magnetic game as set forth in claim 1 wherein said magnetic plate comprises a one-piece permanent ceramic magnet and said magnetic target elements comprise smaller permanent ceramic magnets whereby said plate and said elements constitute a magnetic circuit.

3. A magnetic game as set forth in claim 2 wherein each said magnetic target element comprises a central hole providing a neutral area for the alignment of said game ball on the center of said target area over said magnetic target element.

4. A magnetic game as set forth in claim 2 wherein said metallic sheet provides an amplifying means and a keeper for said magnetic circuit.

5. A magnetic game as set forth in claim 1 including means for adjusting and maintaining said gameboard in a level position which comprises an adjustable stand affixed to the underneath side of said gameboard and a visible bubble mounted flush on said top plate above said central recess.

6. A magnetic game as set forth in claim 1 wherein at least one of said magnetic target elements comprises a magnetizable core surrounded by an electrical coil such that an electrical current flowing through said coil will induce magnetism in said magnetic target element.

* * * * *